US005876511A

United States Patent [19]

Till

[11] Patent Number: 5,876,511

[45] Date of Patent: Mar. 2, 1999

[54] METHOD FOR CLEANING AND RINSING CONTAINERS

[75] Inventor: Volker Till, Hoffheim am Taunus, Germany

[73] Assignee: GEA Till GmbH & Co., Kriftel, Germany

[21] Appl. No.: 764,054

[22] Filed: Dec. 12, 1996

Related U.S. Application Data

[63] Continuation-in-part of Ser. No. 382,904, Feb. 2, 1995, abandoned.

[30] Foreign Application Priority Data

Feb. 2, 1994 [DE] Germany ..... 44 03 141.6

[51] Int. Cl.[6] ..... B08B 3/04; B08B 9/08; C23G 1/02; C23G 1/04

[52] U.S. Cl. ..... 134/22.1; 134/3; 134/10; 134/22.18; 134/26; 134/27; 134/28; 134/41

[58] Field of Search ..... 134/28, 27, 10, 134/26, 41, 22.1, 29, 22.12, 22.13, 22.17, 22.18

[56] References Cited

U.S. PATENT DOCUMENTS

| | | | |
|---|---|---|---|
| 1,642,419 | 9/1927 | Loew | 134/29 |
| 3,121,027 | 2/1964 | Galanor | 134/10 |
| 3,134,070 | 5/1964 | Meyer | 324/30 |
| 3,798,066 | 3/1974 | Evans | 134/27 |
| 4,039,349 | 8/1977 | Kwasnoski | 134/10 |
| 4,094,329 | 6/1978 | Evans | 134/56 R |

FOREIGN PATENT DOCUMENTS

| | | |
|---|---|---|
| 2943110A1 | 5/1981 | Germany . |
| 3424711A1 | 2/1986 | Germany . |
| 3628165A1 | 2/1988 | Germany . |
| 9310151U1 | 10/1993 | Germany . |
| WP 92/10314 | 6/1992 | WIPO . |

*Primary Examiner*—Zeinab El-Arini
*Attorney, Agent, or Firm*—Wenderoth, Lind & Ponack, L.L.P.

[57] ABSTRACT

Beverage containers such as kegs are cleaned by pre-rinsing the containers and then cleaning the containers with a cleaning solution. Post-rinse of the containers is carried out in order to remove the cleaning solution. The post-rinse includes an earlier rinsing phase in which a containers is rinsed with a first rinsing fluid, and a later rinsing phase rinses out one of the containers that has gone through the earlier rinsing phase with a second rinsing fluid. The second rinsing fluid that has been used in the later rinsing phase is used as the first rinsing fluid in the earlier rinsing phase of the post-rinse.

23 Claims, 2 Drawing Sheets

METHOD FOR CLEANING AND RINSING CONTAINERS

This is a Continuation-In-Part of U.S. patent application Ser. No. 08/382,904, filed Feb. 2, 1995, now abandoned.

BACKGROUND OF THE INVENTION (1) Field of the Invention

The present invention relates to a process for cleaning containers, in particular containers such as casks or kegs. Particularly, the present invention relates to a process for cleaning such containers in which a cleaning solution is poured into a container, after which the container is rinsed with a suitable rinsing fluid such as water or the like. The present invention is further directed to an apparatus for cleaning containers in accordance with this process.

(2) State of the Prior Art

In the beverage industry, as in many other branches of industry, large fluid containers are used. In the beverage industry, such containers are casks or kegs that can have valves mounted thereto. These types of containers are normally returnable to the supplier after use by the customer for refilling at a bottling plant. Prior to a refilling operation, however, the containers have to be cleaned in order to remove any residue from the beverage or other liquid that was previously in the container and any other contaminants. The beverage industry, being a part of the food industry overall, has particularly high demands placed thereon for the degree of cleanliness of the containers used for beverages.

Cleaning of such containers is normally performed by first pre-rinsing the container in order to remove the coarsest residue. Thereafter, the container is rinsed with a cleaning solution having a high chemical content, or a similar cleaner, so that even stubborn contaminants are removed due to the high chemical content of the solution. Of course, before each container can be refilled and reused, the container has to be completely chemical free. As such, the containers are "post-rinsed" with a post-rinsing fluid, usually water. This post-rinsing operation is customarily carried out over a fixed period of time that is sufficient to ensure that the container will be completely chemical free. Certain precautionary steps, however, are also taken in order to account for situations where, for example, the chemical concentration of the cleaning solution or cleaning agent may be raised due to some malfunction in the cleaning operation. These precautionary steps involve having the post-rinsing take place over a considerably longer period of time than would normally be necessary to clean the container. While this of course results in an additional consumption of water, this is accepted for safety reasons.

Nor is it possible to check the post-rinsing fluid as it flows out of the container after rinsing to determine when the fluid becomes totally free of chemicals. If such a check could be made, the post-rinsing operation could be controlled, for example by means of a pH meter. Conventional solutions that are used as cleaning fluids have concentrations of 1.5 to 2.5%, and thus a pH value of 14. However, this pH value is obtained when the cleaning solutions are rinsed out of a container to such a degree that the post-rinsing fluid draining from the container shows only a residual concentration of about 0.4%. It is not until the concentration drops below this value that the pH value will fall rapidly. When the post-rinsing operation is completed, a pH value of 7 (neutral value) is reached. However, with the known methods of measuring, it is not possible to determine the pH value at the same time as the pH is dropping in the post-rinsing fluid draining out of the container. A conventional pH measuring cell will need a considerably longer period of time in order to fall from a pH value of 14 to a pH value of 7 than is actually required for the post-rinsing operation. Thus the reaction speed of conventional pH measuring cells is inadequate to control the post-rinsing operation during the cleaning operation of the containers.

German patent No. 3,424,711 uses at least one conductivity measuring probe in both an approach flow and a return flow of a cleaning agent being conveyed into and then away from an object being cleaned. A conductivity comparison element continuously processes paired readings of the probes and transmits a signal when the values of the paired readings reach a predetermined minimal difference. That is, when the conductivity measuring probe is located both in the approach flow at the entry to the working area of the cleaning facility and in a return flow at the exit from the working area, the change of the electrical conductivity of the cleaning agent as it passes through the work area can be determined. When the change falls below a pre-established minimal difference, the particular cleaning phase can be terminated and another working phase can be subsequently initiated.

However, in this patent the post-rinse phase requires the addition of a certain delay or run-out time. Furthermore, the present inventor has found that using electrical conductance as a parameter for stopping the introduction of a rinsing fluid is unsuitable. Employment of electrical conductance was one of the subject matters set forth in parent application 08/382,904. However, in subsequent tests, it has been found that when using hot water as a rinsing fluid in the last rinsing phase, the electrical conductance reaches the value of the hot water after six seconds, i.e. at a first measuring step. Thus using electrical conductance in practice has been found not to provide acceptable results.

SUMMARY OF THE INVENTION

It is an object of the present invention to improve methods of cleaning containers so that the amount of fluid consumption is reduced during a post-rinse operation.

This object is accomplished by a method according to the present invention in which containers are rinsed in multiple rinsing phases. In a first or previous rinsing phase, a container is rinsed with a post-rinsing fluid that was previously used in a second or subsequent rinsing phase for cleaning a container. In other words, a cascade arrangement of the cleaning process is formed so that only the portion of the post-rinsing fluid that has a high chemical content, produced during the first rinsing phase, will be conveyed to a waste water or reprocessing system. The portion of the post-rinsing fluid that has a smaller chemical concentration can be taken from the subsequent rinsing phases and reused in the earlier rinsing phases. Thus the consumption of post-rinsing fluid, typically water, is significantly reduced.

According to a preferred embodiment of the invention, the process comprises a first step of cleaning containers with a cleaning solution, e.g. an acid solution, or possibly a caustic solution. A second step of post-rinsing containers to remove the cleaning solution of the first step is then provided, the second step comprising a plurality of rinsing phases. The rinsing phases include an earlier rinsing phase in which one of the containers is rinsed with a post-rinsing fluid, and a later rinsing phase in which one of the containers that has gone through the earlier rinsing phase is rinsed with a post-rinsing fluid. The post-rinsing fluid that has been used in the later rinsing phase is used as the post-rinsing fluid in the earlier rinsing phase.

Preferably, the earlier rinsing phase is a first rinsing phase, and the later rinsing phase is a last rinsing phase, thus forming a two rinsing phase process. In the first rinsing phase, the maximum residual solution is rinsed out of a container, whereas in the second rinsing phase, whose duration could correspond, for example, to the period of time that was previously used as the safe period of time for rinsing, only residual concentrations of the chemicals, if any, are rinsed out of the container. Because the predetermined safety period corresponds to the normal necessary post-rinsing time, the consumption of post-rinsing fluid can be cut in half by providing the second rinsing phase.

Preferably, the later rinsing phase comprises rinsing one of the containers with fresh water as the second post-rinsing fluid. This guarantees that the container will be totally clean.

According to a further preferred feature according to the present invention, the later rinsing phase comprises draining the rinsing fluid used in the later rinsing phase from the container that is being rinsed. The drained rinsing fluid thus forms the post-rinsing fluid for the earlier rinsing phase. A level of freedom from the presence of the cleaning solution in the container being rinsed is determined by testing the drained rinsing fluid so as to determine either the neutrality of the drained rinsing fluid or the level of freedom from the presence of the cleaning solution in the drained rinsing fluid.

The later rinsing phase further preferably includes supplying the rinsing fluid to a container that is being rinsed while the rinsing fluid is draining from the container being rinsed, and stopping the supply of rinsing fluid to the container when the step of testing indicates that the drained rinsing fluid has reached a predetermined set level of the neutrality or freedom from the presence of the cleaning solution.

According to a further preferred feature of the present invention, in the step of testing in the later rinsing phase, the post-rinsing fluid is drained from the container to form the post-rinsing fluid and conducted over a pH value probe. The pH value probe makes it possible to monitor the cleaning operation. Because in the last rinsing phase the cleaning solution has largely been removed from the container, the pH value probe does not have to go from a high pH value of, for example, 14, and then again fall to a median pH value of 7, but only has to be monitored across a range of pH values between 9 and 7, for example. In such a range of pH values, the reaction speed of the pH measuring cell is adequate to isochronously monitor the drop of the pH value during the cleaning operation.

In accordance with the preferred features according to the present invention, in the later rinsing phase the supply of post-rinsing fluid to the container being rinsed in the later rinsing phase is stopped when a predetermined pH value is indicated by the pH value probe. This will ensure that no unnecessary post-rinsing fluid is consumed.

According to a further preferred feature of the present invention, the cleaning solution is an acid including nitric acid and/or phosphoric acid. The step of testing thus comprises determining the content level of phosphate or nitrate in the drained rinsing fluid, and the supply of rinsing fluid to the container is stopped when the content level of the phosphate or nitrate in the drained rinsing fluid is at a set level that corresponds to freedom from the presence of the cleaning solution. For example, the cleaning liquid could include both nitric acid and phosphoric acid. If the main component is nitric acid, then the supply of rinsing fluid is stopped when the level of nitrate in the drained rinsing fluid is about 14 milligrams per liter.

However, it should be recognized that any solution using acid as a main component can be employed for the purpose of stopping the supply of rinsing fluid by having the step of testing determine the content level of compounds containing the radical of the acid that is used as the main component in the cleaning solution, and then stopping the supply of rinsing fluid when that level corresponds to a predetermined level of freedom from the presence of the cleaning solution. Preferably, this point is when the level of compounds containing the radical of the acid used as the main component of the cleaning solution becomes substantially constant. In the case of the cleaning solution having nitric acid as a main component, the level of the content of nitrate in the drained rinsing fluid becomes about 14 milligrams per liter when it becomes substantially constant, and at this point the supply of rinsing fluid can be stopped.

Preferably the rinsing liquid used in the later rinsing phase is hot fresh water. Also preferably, the later rinsing phase is the last rinsing phase.

According to an additional feature of the present invention, it is preferred that the post-rinsing fluid draining from the container in the later rinsing phase is collected in a tank for use as the post-rinsing fluid in the earlier rinsing phase, the earlier rinsing phase including the conductance of the first post-rinsing fluid from the tank to another container being rinsed in the earlier rinsing phase. In this manner a buffer is created so that intermittent breakdowns or standstill of individual stations of a bottling plant can be compensated for.

According to another feature of the present invention, the earlier rinsing phase may comprise draining the post-rinsing fluid from the container that is being rinsed therein through a valve to a drain channel until a predetermined condition is met. After the predetermined condition is met, the post-rinsing fluid is then drained through a second valve to test the neutrality and/or level of freedom from the cleaning solution of the post-rinsing fluid. Before the predetermined condition is met, the post-rinsing fluid drained from the container through the first valve is conducted to a waste fluid processing system. After the predetermined condition is met, the post-rinsing fluid is used as the first post-rinsing fluid in the earlier rinsing phase. The result of the test of the post-rinsing fluid when draining through the second valve can be used to stop the supply of the post-rinsing fluid to the container being rinsed. The predetermined condition may be the elapse of a specified period of time from the beginning of the rinsing of the container being rinsed in the earlier rinsing phase. This condition may also be a specified amount of the post-rinsing fluid having been supplied from the beginning of the rinsing of the container in the earlier rinsing phase. Other similar parameters may also be used for the predetermined condition to provide for a flow transition between the individual rinsing phases.

The object of the present invention is further achieved by the provision of an apparatus for carrying out the above process. Such an apparatus comprises a first post-rinsing station having a rinsing liquid supply pipe for supplying post-rinsing liquid to a container and a drain for collecting the post-rinsing liquid from the container. Further, a second post-rinsing station is provided having a drain connected with the post-rinsing fluid supply pipe of the first post-rinsing station for supplying post-rinsing fluid from the second post-rinsing station to a container at the first post-rinsing station. Preferably, the drain of the second post-rinsing station is connected to the post-rinsing supply pipe of the first post-rinsing station by a return channel connected to the drain of the second post-rinsing station for conducting the post-rinsing fluid from the drain. Further, a holding tank is preferably connected to the return channel for holding the drained post-rinsing fluid. The post-rinsing fluid supply pipe is connected to the holding tank.

According to further preferred features of the apparatus according to the present invention, a pump is located on the post-rinsing fluid supply pipe for pumping the post-rinsing fluid from the holding tank. The return channel preferably has a pH value probe located therein between the drain and the holding tank, of other suitable testing equipment.

The second post-rinsing station may have the drain thereof connected in parallel to a first valve leading to an outflow channel and a second valve leading to the post-rinsing fluid supply pipe of the second post-rinsing station. The pH probe would then be located between the second valve and the second rinsing station.

BRIEF DESCRIPTION OF THE DRAWINGS

The above features and advantages of the present invention will become more apparent from the following detailed description of a preferred embodiment of the invention, taken together with the accompanying drawings, in which.

DETAILED DESCRIPTION OF THE PREFERRED EMBODIMENT

Figure 1:
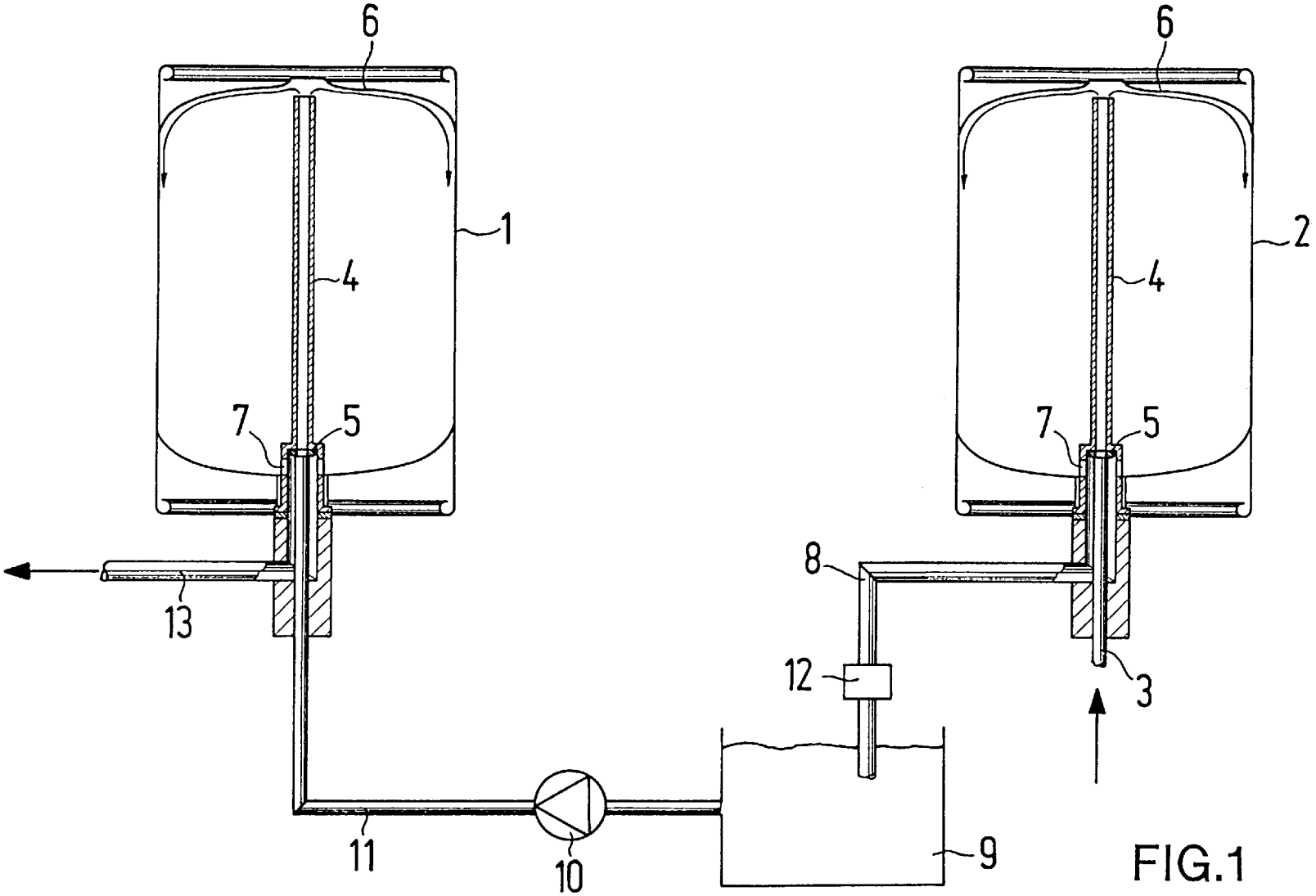
FIG. 1 is a partly schematic and partly sectional side view of an apparatus according to a preferred embodiment of the present invention.

A system according to the present invention is illustrated in FIG. 1, provided for implementing the process according to the present invention. In this figure, a first rinsing phase is conducted with a first container, a keg 1, which is illustrated on the left side of the drawing, and a second or subsequent rinsing phase is conducted with a second container, or keg 2, illustrated on the right side of the drawing.

In the drawing, there are two post-rinsing stations illustrated, the first having the keg 1 thereat and the second having the keg 2 thereat. Each rinsing station includes a post-rinsing fluid supply pipe extending into a housing. The housing forms a drain, but the supply pipe extends through the drain to an extractor tube 4. The supply pipe is seated on the end of the extractor tube 4 through a seal 5. The extractor tube 4, as can be seen in the figures, extends to the inverted bottom end of the keg for supplying the post-rinsing fluid into the keg. Outlet openings 7 in the portion of the extractor tube 4 connecting to the housing form a part of the drain.

In the second post-rinsing station, on the right hand side of the figure, the rinsing fluid, preferably water, is fed to the second keg 2 through a supply pipe 3 and the extractor tube 4. The rinsing fluid is conducted through the seal 5 to the extractor tube 4 and to the inverted bottom end of the keg 2. The rinsing fluid is thus injected into the keg against a floor 6 of the keg 2. The path of the rinsing fluid during the supply thereof into the keg 2 is illustrated with the arrows in the drawing figure.

The post-rinsing fluid then drains through the outlet openings 7 of the drain to a return channel 8. The return channel 8 leads to a collecting tank 9 that collects and holds the post-rinsing fluid from the second post-rinsing station. The post-rinsing fluid held by the collecting tank 9 is fed by a pump 10 through a supply pipe 11 to the first keg 1 at the first rinsing station. The feed of the post-rinsing fluid from the collecting tank 9 into the keg 1 is similar to the feed of the post-rinsing fluid into the keg 2. The post-rinsing fluid that has been fed into the keg 1 drains through the outlets 7 through the drain of the first post-rinsing station and therefrom through an outflow channel 13 to a waste water processing system (not shown).

In the return channel 8 extending from the second post-rinsing station, there is, for example, a pH value probe 12 that is provided therein in order to determine the pH value of the post-rinsing fluid draining from the second keg 2. However, in place of the pH value probe 12, other types of measuring devices for determining the neutrality or level of freedom from the cleaning solution of the post-rinsing fluid draining from the keg 2 can be provided.

The operation of the apparatus described in FIG. 1, and in accordance with the process according to the present invention, is described below with reference to the cleaning of the illustrated kegs 1 and 2.

Returnable containers are returned to a bottling plant for the purpose of being refilled. These containers first have to be cleaned prior to being refilled. As such, the coarsest residues in the container from their previous use, and other impurities, are first removed in a pre-rinse operation. Because high demands are placed on the cleanliness of beverage and food containers in the beverage and food industry, the returnable containers then have to be thoroughly rinsed with a cleaning solution so that even stubborn contaminants will be dissolved. One type of cleaning solution that could be employed is an acidic cleaning liquid. For example, 1.81% concentrated Divomil ES, a product of Diversey Corp., could be used. This product comprises nitric acid as a main component, and also includes phosphoric acid and corrosion inhibitors. The types of cleaning solutions employed, however, have a relatively high chemical content, so that before the containers can be refilled and reused, it must be ensured that the containers are completely free of chemicals. According to the present invention, this is accomplished by post-rinsing the containers in multiple rinsing phases.

In a first post-rinsing phase, the coarsest portion of the cleaning solution is rinsed out of the containers, as illustrated by keg 1 being placed on the first post-rinsing station in FIG. 1. The chemical concentration is then significantly reduced. The post-rinsing fluid that drains from the keg 1 during the first post-rinsing phase is then fed to a waste fluid or waste reprocessing system.

In a second post-rinsing phase, the container, as illustrated by keg 2 in FIG. 1, is thoroughly rinsed with fresh water being fed to the container through the supply pipe 3 and the extractor tube 4. Because the chemical concentration in this second rinsing phase is already relatively low due to the first rinsing phase, the post-rinsing fluid that drains from the keg 2 during the second rinsing phase can be used for conducting the first rinsing phase for a container such as the keg 1. By so reusing the post-rinsing fluid of the second rinsing phase, the water consumption can be drastically reduced as compared with the prior art.

Thus the post-rinsing fluid that drains from the second keg 2 is conveyed through the return channel 8 to the holding tank 9. The pH value of the post-rinsing fluid draining from the keg 2 is determined by means of the pH value probe 12 in the return channel 8. As soon as the pH value probe 12 indicates a neutral value (pH 7, or 6.5–7.5; i.e. substantially neutral), the post-rinsing operation for the keg 2 can be terminated, because all of the chemicals have been removed from the keg 2. The safety period that is required in the prior art for the purpose of guaranteeing the complete absence of chemicals can thus be reduced in this manner to the amount that is actually necessary, thus further reducing the consumption of water.

The pH value probe 12 can be used for controlling the post-rinsing operation. Because the starting concentration of the chemicals at the beginning of the second post-rinsing phase for the keg 2 is already relatively low, the pH value probe 12 does not have to first increase to a relatively high pH value before then proceeding to drop towards the neutral value as the second post-rinsing phase is conducted. Rather, the pH value that is to be detected and indicated by the pH value probe 12 is approximately in the range of a pH of 9 to a pH value of 7. And in fact, the reaction speed of the pH value probe 12 while falling across this range of 9 to 7 corresponds approximately to the rate of reduction of the chemical concentration in the post-rinsing fluid.

As discussed above, the post-rinsing fluid that is collected in the tank 9 from the second keg 2 is fed by the pump 10 into the supply line 11 and to the first keg 1 for implementing the first rinsing phase. Because the original chemical concentration of a keg that has not yet been rinsed is higher than that of the post-rinsing fluid draining from the keg 2 during the second rinsing phase, the bulk of the residual solution from the first keg 1 can be rinsed out with the post-rinsing fluid that is being reused from the second rinsing phase, and the corresponding chemical concentration can be significantly reduced.

A period of time will be determined necessary for removing or reducing typical chemical concentrations in the keg 1 in the first rinsing phase. If the second rinsing phase has a typical time period that is regarded as a safety period that is just as long as the necessary time period in the first rinsing phase, then the water consumption can be reduced by up to 50% by means of the cascade arrangement according to the present invention.

As discussed above, the kegs 1 and 2 as illustrated in FIG. 1 and discussed with respect to the process in the foregoing are preferably post-rinsed in two rinsing phases. However, additional rinsing phases can be provided and the post-rinsing fluid draining from the respective kegs at the respective rinsing stations reused in the same manner as above. For example, outflow pipe 13 could be connected to a preceding post-rinsing station for the supply of post-rinsing fluid thereto. Fresh water is to be used only in the last rinsing phase, however.

Figure 2:
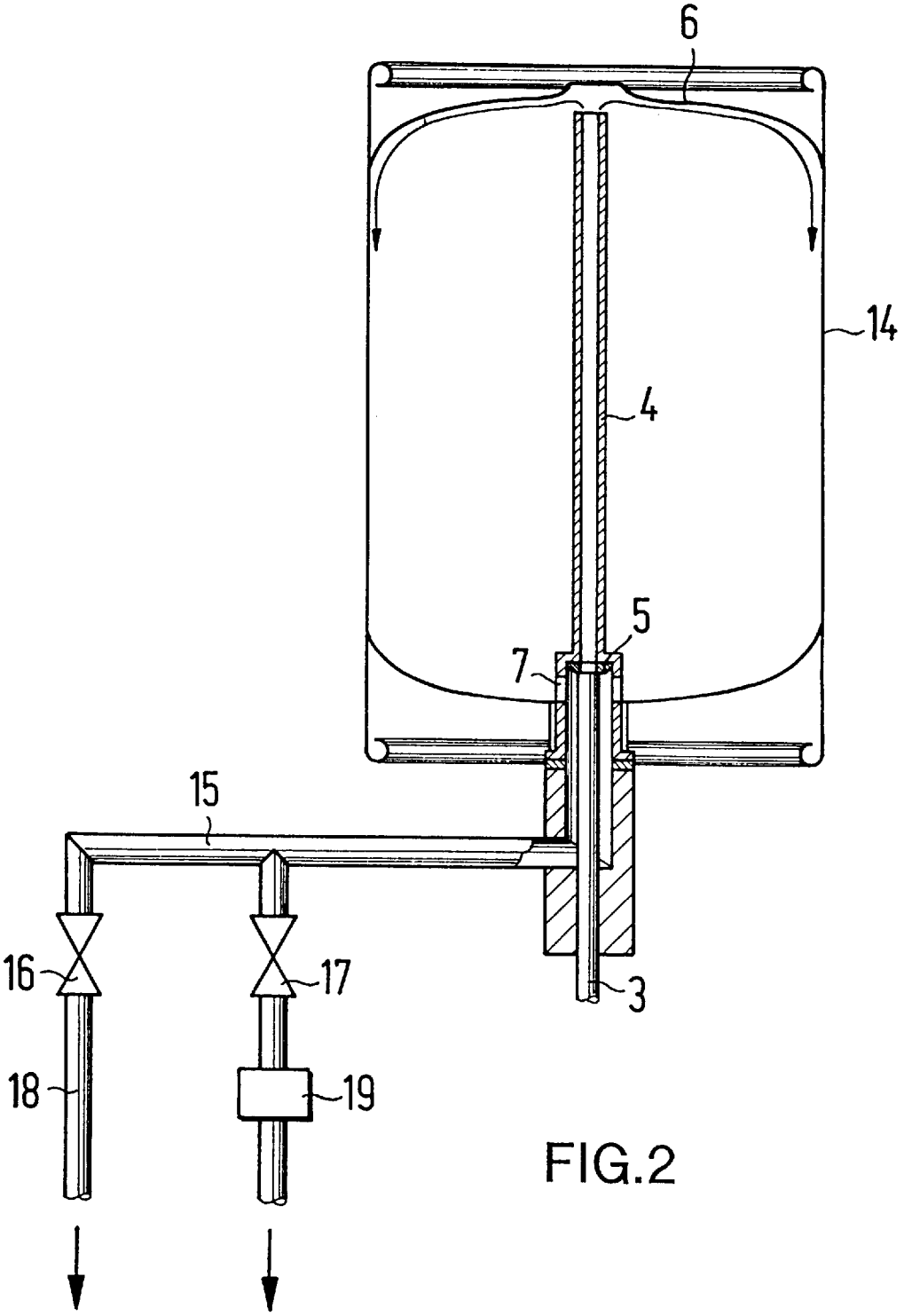
FIG. 2 is a schematic side view, partly in section, of a modification of the apparatus according to the preferred embodiment of the present invention.

FIG. 2 illustrates a second embodiment of the apparatus and process according to the present invention. In this figure, a keg 14 is illustrated together with a rinsing station similar to the second rinsing station in FIG. 1. However, with this embodiment a return channel 15 is connected in parallel to a first valve 16 and a second valve 17. The return channel 15 can be connected by the first valve 16 to an outflow channel 18, which may lead to a waste fluid or waste water processing system. The return channel 15 can also be connected by the second valve 17 to a pH value probe 19 or the like. Through the second valve 17 and the pH value probe 19, the post-rinsing fluid can be conducted for reuse in a preceding rinsing phase similar to the embodiment of FIG. 1, i.e. the post-rinsing fluid could be conveyed to another keg, or the post-rinsing fluid could be conducted to a waste fluid or waste water processing system.

A process of rinsing a keg 14 according to a second embodiment of the present invention will now be described with reference to FIG. 2.

When the keg 14 is rinsed, the first valve 16 is opened and the second valve 17 is closed during a first rinsing phase. The duration of the first rinsing phase will correspond, for example, to the period of time that is necessary to remove the usual chemical concentrations. For example, the keg 14 may not have undergone a preceding rinsing phase, and the post-rinsing fluid draining therefrom may initially have high chemical concentrations. Therefore, during the first rinsing phase the post-rinsing fluid draining from the keg is fed to the waste fluid or waste water processing system.

After a predetermined amount of time, or after a specific amount of post-rinsing fluid has flowed out, or after some other similar parameter has been reached, the first valve 16 is closed, and the second valve 17 is opened. The post-rinsing fluid that is now draining flows over the pH value probe 19 so that the pH value of the post-rinsing fluid can be determined in the manner described above with respect to the embodiment of FIG. 1. In other words, the pH value probe 19 is used so that it can be determined when the draining post-rinsing fluid becomes neutral, i.e. without chemicals.

The pH value probe 19 can be connected to a control system of the post-rinsing rinsing operation, so that when the neutral pH value is reached, the post-rinsing operation for the keg 14 can be terminated. The post-rinsing fluid that drains during the second rinsing phase can either be fed to the waste fluid or waste water processing system, or the post-rinsing fluid can be reused in the manner discussed above, i.e. fed to another keg for the purpose of conducting the preceding rinsing phase.

A method of the present invention can, alternatively to the use of a pH value probe, use the level of content of, for example, phosphate or nitrate as a suitable parameter to stop the introduction of post-rinsing fluid during the later or last post-rinsing stage. That is, the point of using the pH probe is to determine when the rinsing fluid that is draining from the container during the later or last rinsing phase is substantially neutral. This is to correspond to substantial freedom from the presence of the cleaning solution. When using a cleaning solution such as one containing nitric acid and phosphoric acid, the acid, during the process of cleaning, forms nitrates. That is, compounds are formed that include the radical of the acid that is employed in the cleaning solution. Thus, the level of freedom from the cleaning solution could be determined by the level of compounds that include the free radical of the acid of the cleaning solution in the rinsing fluid that is draining from the container. In practice, a certain level of phosphates and nitrates will most likely always be present. However, at some point during the process, for example the level of nitrate becomes substantially constant.

TABLE ONE

| Sample | Amount of Cleaning Liquid used [1] | Content of phosphate [mg/l] | Content of nitrate [mg/l] |
|---|---|---|---|
| Hot Water | | 0.24 | 10.3 |
| 6s (sample taken after 6 seconds post-rinsing time) | 4.2 | 1.02 | 24.3 |
| 9s | 6.3 | 0.95 | 20.5 |
| 12s | 8.4 | 0.88 | 19.5 |
| 14s | 9.8 | 0.79 | 15.7 |
| 16s | 11.2 | 0.76 | 14.2 |
| 18s | 12.6 | 0.75 | 14.1 |
| 20s | 14 | 0.63 | 14.1 |

TABLE ONE-continued

| Sample | Amount of Cleaning Liquid used [1] | Content of phosphate [mg/l] | Content of nitrate [mg/l] |
|---|---|---|---|
| Beer | | about 600 | about 14 |
| Maximum content allowable under the German regulation for drinking water | | 6.7 | 50 |

Tests were conducted as are reflected in the above Table One using the above-referenced cleaning solution (Divomil ES). This table shows the evolution of the content of phosphate and nitrate during the post-rinsing cycle. The results were obtained by interrupting the hot water rinsing step after a predetermined amount of time, indicated in the left-hand column. Then a sample was taken of 100 milliliters of liquid out of five kegs for each such time cycle. The five samples taken for one time cycle were mixed in order to obtain an average for the five separate keg samples, and analyzed in a laboratory. The results are shown in the table.

For example, even in hot water there is a certain content of phosphate and nitrate. After six seconds, 4.2 liters of cleaning liquid had been used, and the contents of phosphates and nitrates quickly rose. Thereafter, noting the intervals indicated on the table, the levels of phosphate and nitrate gradually dropped.

It is noted that the content of phosphate was determined photometrically, while ion-chromatography was used to determine the content of nitrate.

The test results show that the content of phosphate is already quite low after six seconds of rinsing, and drops from a value of 1.02 milligrams per liter to 0.63 milligrams per liter at the end of the rinsing step. The value of the hot rinsing water was 0.24 milligrams per liter, but this value was not reached. The maximum content of phosphate that is allowable under, for example, German regulations for drinking water, is 6.7 milligrams per liter. The examination of a sample of beer showed a content of phosphate of about 600 milligrams per liter.

The examination of the content of nitrate showed a drop from 24.3 milligrams per liter to 14.2 milligrams per liter after 16 seconds. After this, the level of nitrate remains substantially constant. Again referring to German drinking water regulations, it is noted that the maximum value that is allowable for the content of nitrate is 50 milligrams per liter. The beer sample showed a content of nitrate of 14 milligrams per liter.

Thus, these tests established that the content of phosphate and nitrate nearly reaches the detection limit after 16 seconds of rinsing. This means that the cleaning liquid is almost completely removed from the keg. The test results further show that it is possible to reduce the rinsing step from 20 seconds to 16 seconds, i.e. by about 20%, without impairing the quality of the beer that is eventually refilled into the containers being cleaned. Thus, the determination of the level of phosphate or nitrate can serve as a suitable parameter for the determination of an acceptable cleanliness of the keg.

With nitric acid as the main component of the cleaning liquid, nitrate showed to be a better parameter according to the above tests results. It is thus likely that whatever acid may be used as the main component of a cleaning liquid, the compounds containing the radical of the acid used as the main component may well be the better parameter.

While the present invention has been discussed above with respect to details of the preferred embodiments of the invention, various changes and modifications to the preferred embodiments will be apparent to those of skill in this art. Such changes and modifications should be considered within the scope of the present invention as defined in the appended claims.

I claim:

1. A process of cleaning containers, comprising:

a first step of cleaning containers with a cleaning solution; and a second step of rinsing containers to remove the cleaning solution of said first step, said second step comprising a plurality of rinsing phases, including:

an earlier rinsing phase in which one of the containers is rinsed with a post-rinsing fluid, and a later rinsing phase in which one of the containers that has gone through said earlier rinsing phase is rinsed with a rinsing fluid, wherein the rinsing fluid that has been used in said later rinsing phase is used as the post-rinsing fluid in said earlier rinsing phase;

wherein said later rinsing phase comprises draining the rinsing fluid used in said later rinsing phase from the container being rinsed, the drained rinsing fluid thus forming the post rinsing fluid for said earlier rinsing phase, and determining a level of freedom from the presence of the cleaning solution in the container being rinsed by testing the drained rinsing fluid to determine at least one of the neutrality and level of freedom from the presence of the cleaning solution in the drained rinsing fluid, and wherein said later rinsing phase further comprises supplying the rinsing fluid to the container being rinsed while the rinsing fluid is draining from the container being rinsed, and stopping the supply of rinsing fluid to the container when said testing indicates that the drained rinsing fluid has reached a predetermined set level of at least one of neutrality and freedom from the presence of the cleaning solution.

2. The method of claim 1, wherein said testing comprises conducting the drained rinsing fluid over a pH value probe and said of stopping comprises stopping the supply of rinsing fluid to the container when the pH value probe indicates a set pH value corresponding substantially to neutrality of the rinsing fluid.

3. The method of claim 1, wherein said first step of cleaning containers comprises cleaning with a cleaning solution that includes at least one material selected from the group consisting of nitric acid and phosphoric acid.

4. The method of claim 3, wherein said testing comprises determining the content level of at least one of phosphate and nitrate in the drained rinsing fluid and said stopping comprises stopping the supply of rinsing fluid to the container when the content level of at least one of phosphate and nitrate in the drained rinsing fluid is at a set level corresponding to freedom from the presence of the cleaning solution.

5. The method of claim 3, wherein the step of stopping comprises stopping the supply of rinsing fluid to the container being rinsed when the level of nitrate in the drained rinsing fluid is about 14 mg/l.

6. The method of claim 1, wherein the cleaning solution comprises an acidic cleaning liquid that includes both nitric acid and phosphoric acid.

7. The method of claim 1, wherein said first step of cleaning comprises using a cleaning solution that has an acid as a main component, and said of stopping comprises stopping the supply of rinsing fluid to the container when a content level of compounds containing a radical of the acid used as the main component in the cleaning solution in the drained rinsing fluid is at a set level corresponding to a predetermined level of freedom from the presence of the cleaning solution.

8. The method of claim 7, wherein the set level corresponding to a predetermined level of freedom from the presence of the cleaning solution is a level at which the level of compounds containing the radical of the acid used as the main component in the cleaning solution becomes substantially constant.

9. The method of claim 7, wherein the cleaning solution comprises nitric acid as a main component, phosphoric acid and corrosion inhibitors, and wherein the set level corresponding to a predetermined level of freedom from the presence of the cleaning solution is a level at which the content of nitrate of the drained rinsing fluid becomes about 14 mg/l.

10. The process of claim 7, wherein said later rinsing phase comprises rinsing one of the containers with hot fresh water as the post-rinsing liquid.

11. The process of claim 1, wherein said earlier rinsing phase is a first rinsing phase and said later rinsing phase is a last rinsing phase.

12. The process of claim 1, wherein said later rinsing phase further comprises draining the post-rinsing fluid used in said later rinsing phase from the container being rinsed, the drained post-rinsing fluid thus forming the post-rinsing fluid for said earlier rinsing phase, and conducting the post-rinsing fluid over a pH value probe.

13. The process of claim 1, wherein said later rinsing phase further comprises draining the post-rinsing fluid from the container being rinsed and collecting the post-rinsing fluid in a tank, and wherein said earlier rinsing phase further comprises conducting the post-rinsing fluid from the tank to another container being rinsed to perform said earlier rinsing phase.

14. The process of claim 1, wherein said second step further comprises draining the rinsing fluid from the container being rinsed in said earlier rinsing phase through a valve to a drain channel until a predetermined condition is met, and after said predetermined condition is met, draining the rinsing fluid through a second valve in order to conduct said step of testing.

15. The process of claim 14, wherein the rinsing fluid drained from the container being rinsed in said earlier rinsing phase is conducted to a waste fluid processing system until said predetermined condition is met, and after said predetermined condition is met the rinsing fluid is used as the post-rinsing fluid in said earlier rinsing phase.

16. The process of claim 14, wherein said step of stopping the supply of rinsing fluid to the container is carried out when a pH value probe indicates a predetermined pH value of the drained rinsing fluid.

17. A process of cleaning containers, comprising:

a first step of cleaning containers with a cleaning solution comprising an acid as a main component; and a second step of rinsing containers to remove the cleaning solution of said first step, said second step comprising a plurality of rinsing phases, including:

an earlier rinsing phase in which one of the containers is rinsed with a post-rinsing fluid, and a later rinsing phase in which one of the containers that has gone through said earlier rinsing phase is rinsed with a rinsing fluid, wherein the rinsing fluid that has been used in said later rinsing phase is used as the post-rinsing fluid in said earlier rinsing phase;

wherein said later rinsing phase comprises draining the rinsing fluid used in said later rinsing phase from the container being rinsed, the drained rinsing fluid thus forming the post rinsing fluid for said earlier rinsing phase, for a specified period of time from the beginning of said later rinsing phase, said specified period of time corresponding to the period of time it takes for a content level of compounds including a radical of the acid that is the main component of the cleaning solution to reach a substantially constant level.

18. The process of claim 17, wherein the acid that is the main component of the cleaning solution is nitric acid, and the specified period of time corresponds to the period of time it takes for the content level of nitrate in the drained rinsing fluid in said later rinsing phase to reach a substantially constant level.

19. The process of claim 17, wherein the specified period of time is 16 seconds.

20. A process of cleaning containers, comprising:

a first step of cleaning containers with a cleaning solution; and a second step of rinsing containers to remove the cleaning solution of said first step, said second step comprising a plurality of rinsing phases, including:

an earlier rinsing phase in which one of the containers is rinsed with a post-rinsing fluid, and a later rinsing phase in which one of the containers that has gone through said earlier rinsing phase is rinsed with a rinsing fluid, wherein said later rinsing phase comprises draining the rinsing fluid used in said later rinsing phase from the container being rinsed, the drained rinsing fluid thus forming the post rinsing fluid for said earlier rinsing phase, and determining a level of freedom from the presence of the cleaning solution in the container being rinsed by testing the drained rinsing fluid to determine at least one of the neutrality and level of freedom from the presence of the cleaning solution in the drained rinsing fluid; and wherein said second step further comprises draining the post-rinsing fluid from the container being rinsed in said earlier rinsing phase through a valve to a drain channel until a predetermined condition is met, and after said predetermined condition is met, draining the post-rinsing fluid through a second valve to conduct said testing; and wherein said later rinsing phase further comprises supplying the rinsing fluid to the container being rinsed while the rinsing fluid is draining from the container being rinsed, and stopping the supply of rinsing fluid to the container when the step of testing indicates that the drained rinsing fluid has reached a predetermined set level of at least one of neutrality and freedom from the presence of the cleaning solution.

21. The process of claim 20, wherein the post-rinsing fluid drained from the container being rinsed in said earlier rinsing phase is conducted to a waste fluid processing system until said predetermined condition is met, and after said predetermined condition is met said later rinsing phase begins and the post-rinsing fluid is used as the post-rinsing fluid in said earlier rinsing phase.

22. The process of claim 20, wherein said predetermined condition is a specified period of time having elapsed from the beginning of the rinsing of the container being rinsed in said earlier rinsing phase.

23. The process of claim 20, wherein said predetermined condition is a specified amount of rinsing fluid having been supplied from the beginning of the rinsing of the container being rinsed in said earlier rinsing phase.

* * * * *